United States Patent [19]

Hinzmann

[11] Patent Number: 4,633,923

[45] Date of Patent: Jan. 6, 1987

[54] APPARATUS FOR FILLING INK CARTRIDGES

[75] Inventor: Alfred Hinzmann, Weams, Va.

[73] Assignee: Hauni-Werke Körber & Co. KG., Hamburg, Fed. Rep. of Germany

[21] Appl. No.: 729,548

[22] Filed: May 2, 1985

[51] Int. Cl.[4] ..... B65B 3/04

[52] U.S. Cl. ..... 141/116; 141/256

[58] Field of Search ..... 141/1–12, 141/89, 90, 91, 92, 115, 116, 126, 127, 250–284; 417/446, 567, 568

[56] References Cited

U.S. PATENT DOCUMENTS 4,230,160 10/1968 Buckley ..... 141/116

*Primary Examiner*—Houston S. Bell, Jr.
*Attorney, Agent, or Firm*—Peter K. Kontler

[57] ABSTRACT

Apparatus for filling ink cartridges which are used in printer units of cigarette making machines has a frame which can removably support an empty cartridge in register with a stationary housing having a reciprocable plunger with axial and radial bores for evacuation of ink from a chamber in the interior of the housing. The chamber receives ink from a tank by way of a feed screw which is driven by a motor. The plunger reduces the volume of the chamber when it is lifted by the nipple of an empty cartridge, and the plunger then permits ink to flow from the chamber into the cartridge. When the cartridge is filled, a piston in its interior indirectly opens a switch in the circuit of the motor so that the feed screw is arrested. When the cartridge is moved away from the housing, a spring rapidly moves the plunger to a position in which the plunger seals the chamber from the surrounding atmosphere and the volume of the chamber is increased abruptly so that any ink which is contained in the bores of the plunger is sucked back into the chamber. This prevents contamination of the housing, of the cartridge and of the surrounding area.

15 Claims, 4 Drawing Figures

APPARATUS FOR FILLING INK CARTRIDGES

BACKGROUND OF THE INVENTION

The present invention relates to apparatus for filling or refilling containers with flowable media, and more particularly to improvements in apparatus which can be used with advantage for filling and refilling of ink cartridges of the type normally used in cigarette making and analogous machines to supply ink to the so-called printer unit. Printer units are used to apply the brand name, the name of the manufacturer and/or one or more trademarks to the web of cigarette paper or other material which is about to be converted into wrappers of discrete cigarettes or analogous rod-shaped articles of the tobacco processing industry.

As a rule, the cartridge which stores a supply of ink for use in the printer unit of a cigarette maker comprises a cylindrical vessel with a reciprocable piston which can be acted upon to dispense ink at a desired rate when the cartridge is properly inserted in the printer unit. The piston yields when the vessel is in the process of being refilled with ink. Such refilling takes place by way of a nipple which is provided on the front end wall of the vessel and serves to dispense ink in the printer unit in response to forward movement of the plunger.

Heretofore known cartridge filling or loading devices operate not unlike grease guns, i.e., a stream of ink is forced from the spout of the gun into the interior of the vessel by way of the aforementioned nipple whereby the piston yields and advances toward its retracted position, i.e., in a direction away from the nipple. A drawback of such filling devices is that they invariably discharge one or more droplets of ink upon completion of a refilling operation. This results in contamination of the gun, in contamination of the refilled cartridge and in contamination of the surrounding area by a substance which cannot be readily removed. Moreover, the refilling operation is cumbersome and time-consuming, and ink at the discharge end of the gun is likely to incrustate to thus prevent predictable discharge of fresh ink into an empty cartridge.

OBJECTS AND SUMMARY OF THE INVENTION

An object of the invention is to provide a novel and improved apparatus which can be used for rapid and convenient refilling of ink cartridges and analogous containers without any contamination of the source of flowable medium, of the container and/or of the surrounding area.

Another object of the invention is to provide the apparatus with novel and improved means for preventing dripping of the flowable medium from the source of supply when the refilling of a container is completed.

A further object of the invention is to provide the apparatus with novel and improved means for automatically terminating the discharge of a flowable medium from the source when the filling or refilling of a container is completed.

An additional object of the invention is to provide the apparatus with novel and improved means for terminating the admission of flowable medium into a container after the latter receives a predetermined quantity of such medium.

A further object of the invention is to provide the apparatus with novel and improved means for feeding the flowable medium from a main source of supply to the locus of admission of such medium into a container.

An additional object of the invention is to provide a novel and improved method of refilling ink cartridges for use in cigarette makers and like machines.

Still another object of the invention is to provide a simple and compact apparatus which can be used for controlled admission of a wide variety of flowable media into cartridges and analogous containers.

The invention resides in the provision of an apparatus for admitting a flowable medium (such as ink) into containers (particularly into so-called ink cartridges) for use in the printer unit of a machine for the making of cigarettes or analogous rod-shaped articles of the tobacco processing industry. The improved apparatus comprises a tank or another suitable source of supply of flowable medium, a housing which defines a variable-volume chamber for temporary reception and storage of flowable medium, means for feeding the medium from the source into the chamber, and a valving element which is installed in the housing and defines at least one passage for evacuation of flowable medium from the chamber and for entry of the evacuated medium into a container which is placed next to the housing. The valving element is movable (preferably in part by the container) between a first position in which the passage or passages are free to convey flowable medium from the chamber and in which the valving element reduces the volume of the chamber, and a second position in which the volume of the chamber is increased and the passage or passages are sealed. Thus, the volume of the chamber increases while the valving element moves from the first to the second position whereby any flowable medium which is left in the passage or passages during such movement of the valving element is sucked back into the chamber to thus prevent dripping of the flowable medium from the housing when the filling or refilling of a container is completed.

The feeding means preferably comprises a motor-driven feed screw or other suitable means for forcibly advancing flowable medium from the source into the chamber. Such feeding means can comprise a rotary medium-advancing member (e.g., the aforementioned feed screw) which can cause one or more streams of flowable medium to flow from the source into the chamber as soon as the motor is started and as long as the motor is on.

The valving element can comprise a plunger which is reciprocable between the first and second positions in a hole provided therefor in a preferably detachable portion of the housing. The plunger has a peripheral surface which is slidable in the hole of the housing and an end face which is located outside of the chamber. Each passage of such plunger can include one or more bores and has a first end portion in the end face and at least one second end portion in the peripheral surface of the plunger. The second end portion or portions of the passage communicate with the chamber in the first position of the plunger but is or are sealed by the housing when the plunger assumes the second position.

The feed screw can be provided with a rotary disc-shaped medium-distributing element which is adjacent to the housing, and the hosing can comprise a disc shaped member which is adjacent to the distributing element and has one or more apertures (e.g., at least one annulus of apertures) for admission of flowable medium into the chamber. The distributing element is preferably provided with a segment-shaped peripheral opening which sweeps over the annulus or annuli of apertures in the disc-shaped member to admit flowable medium to successive apertures for entry into the chamber.

A coil spring or other suitable means can be provided for yieldably biasing the valving element to its second position. Such biasing means can react against the housing to bear against the valving element and to urge the latter to its second position, e.g., in immediate response to movement of a freshly filled container away from the housing.

The containers to be filled in the apparatus of the present invention are preferably of the type wherein a vessel receives a reciprocable piston which is movable therein in a predetermined direction in response to admission of flowable medium into the vessel. The apparatus then preferably further comprises means for deactivating the feeding means in response to movement of the piston to a predetermined position (which is indicative of a filled or nearly filled vessel) while the piston moves in the predetermined direction. The deactivating means can comprise means for arresting the prime mover for the aforementioned feed screw.

The chamber of the housing is accessible upon detachment of the aforementioned detachable portion (e.g., a screw cap) which carries the valving element. The housing can include a cylinder for the medium advancing element of the feeding means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
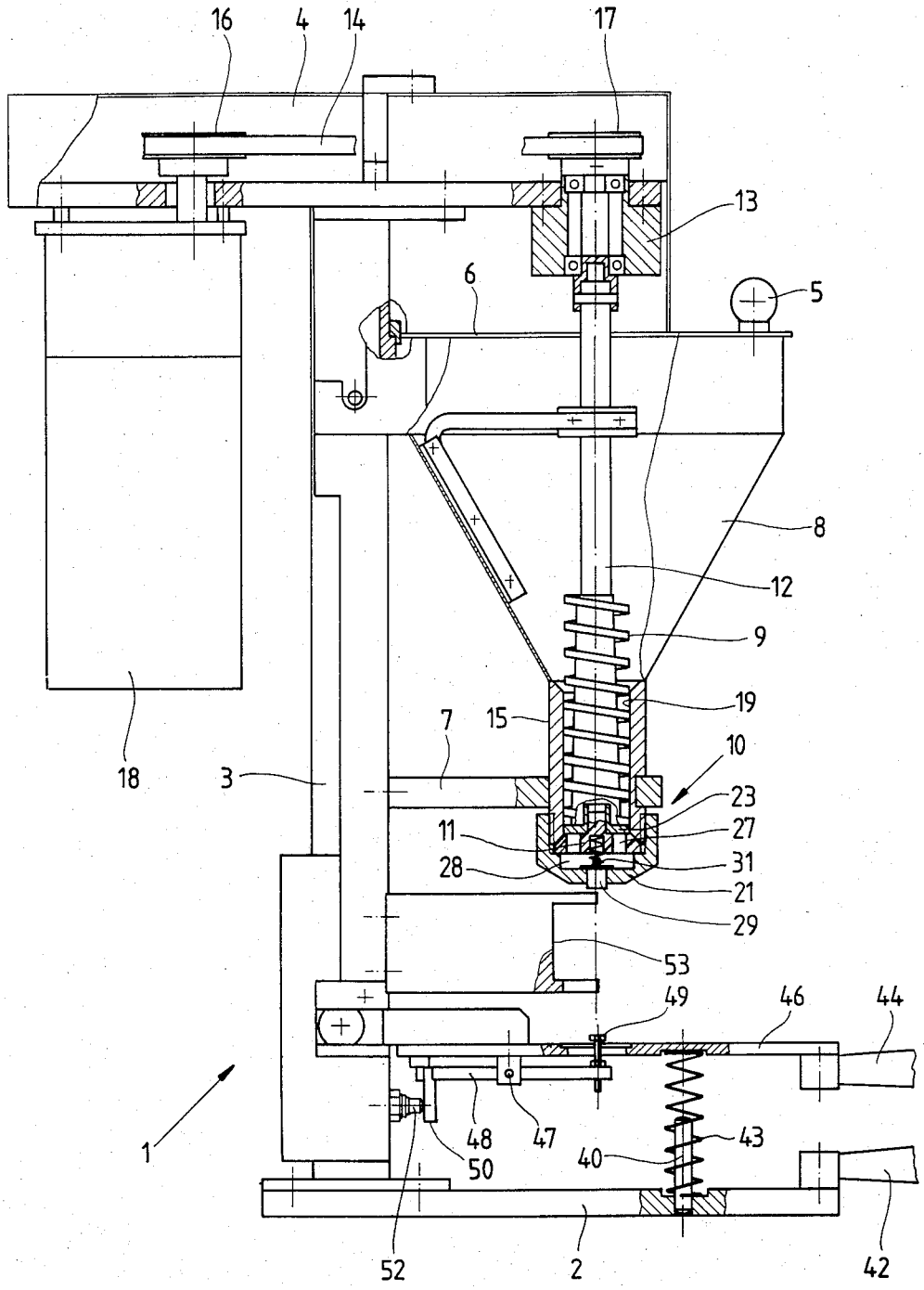
FIG. 1 is a somewhat schematic partly elevational and partly sectional view of an apparatus which embodies the invention, the valving element being shown in the second position.

FIG. 1 shows an apparatus (also called ink cartridge filling device) which can be used to fill or refill containers or cartridges 38 (see FIG. 4) of the type wherein a cylindrical vessel 40 confines a reciprocable piston 51 and the rear wall 40*a* of the vessel has a centrally located opening 40*b* for a pusher (not shown) which is installed in the printer unit of a cigarette maker and serves to move the piston 51 upwardly (as viewed in FIG. 4) in order to expel ink at a desired rate by way of a conical nipple 37 at the outer side of the upper end wall 40*c* of the vessel 40.

The apparatus comprises a frame 1 which includes a leg 2 and an upright 3 whose upper end portion carries a transversely extending beam 4.

The median portion of the upright 3 carries two brackets 6 and 7. The bracket 6 supports a conical tank 8 constituting a source of supply of ink and being refillable upon removal of a bung 5. The lower bracket 7 supports a housing 10 which defines a relatively small chamber 28 for temporary reception and storage of a small supply of ink prior to delivery of such ink into the interior of a cartridge 38. The means for positively or forcibly feeding ink from the tank 8 into the chamber 28 of the housing 10 comprises a rotary advancing element in the form of a feed screw 9 whose lower end portion is rotatable (with minimal clearance) in a cylindrical bore 19 of a sleeve-like portion or cylinder 15 of the housing 10 and whose upper end portion is journalled in a bearing 13 supported by one arm of the beam 4. The other arm of the beam 4 carries an electric motor 18 whose output element can drive a first pulley 16. The pulley 16 can drive a pulley 17 on the shank 12 of the feed screw 9 by way of an endless belt 14. The motor 18 can be arrested in response to depression of a switch 52 which is mounted on the upright 3 at a level below the bracket 7.

Figure 2:
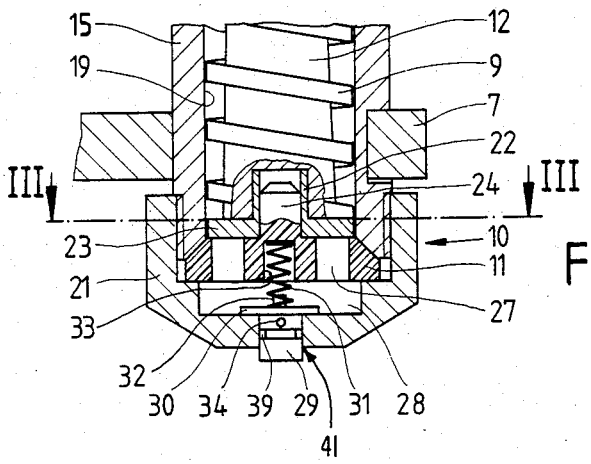
FIG. 2 is an enlarged axial sectional view of the housing and of the lower portion of the rotary medium advancing element of the feeding means, the valving element being again shown in its second position.
Figure 3:
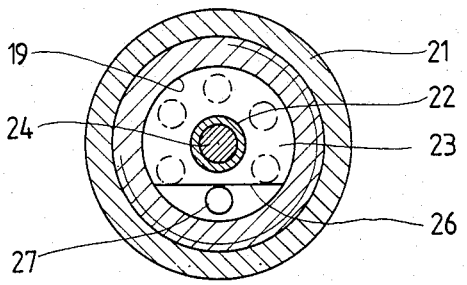
FIG. 3 is a sectional view as seen in the direction of arrows from the line III—III in FIG. 2.
Figure 4:
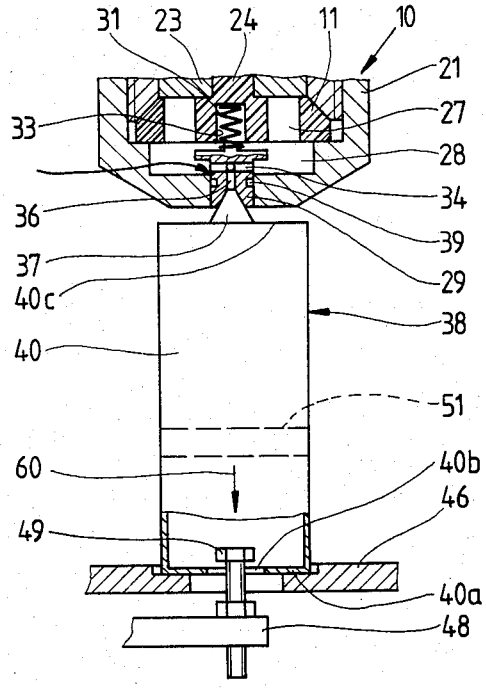
FIG. 4 is an axial sectional view of the housing with the valving element in the first position, and further showing a container in a position in which its medium-admitting nipple maintains the valving element in the first position.

The housing 10 further comprises a disc-shaped member 11 which is preferably made of a suitable self-lubricating synthetic plastic material and has one or more annuli of apertures 27 (see particularly FIGS. 2 to 4). The lower end portion of the feed screw 9 rotates a disc-shaped distributor 23 which has a segment-shaped peripheral opening 26 (see particularly FIG. 3) arranged to sweep along the annulus of apertures 27 and to thus enable the disc-shaped member 11 to deliver into the chamber 28 discrete streamlets of ink. The member 11 is held in position at the lower end of the sleeve 15 by a detachable housing portion 21 in the form of a screw cap mating with the lower end portion of the sleeve 15.

The lower end portion of the shank 12 of the feed screw 9 is formed with a centrally located socket for a complementary sleeve-like extension 22 of the distributor 23. The latter rotates with the shank 12 and its underside is in direct contact with the upper side of the disc-shaped member 11 which is held against rotation by being clamped between the sleeve 15 and the screw cap 21. The disc-shaped member 11 has an upwardly extending centering pin 24 which is received in the extension 22 of the distributor 23. The chamber 28 is disposed between the underside of the disc-shaped member 11 and the upper side of the bottom wall of the detachable screw cap 21.

The bottom wall of the screw cap 21 has a centrally located cylindrical hole 41 for a reciprocable plunger 29 constituting a valving element and serving not only to permit controlled discharge of ink from the chamber 28 but also to vary the effective volume of the chamber in response to movement from the lower end position of FIG. 2 to the upper end position of FIG. 4 or vice versa. A coil spring 31 is provided in the chamber 28 to yieldably bias the valving element 29 to the lower end position of FIG. 2; the spring 31 reacts against the surface in the deepmost portion of a centrally located socket 33 in the underside of the member 11 and bears against the upper end face of the valving element 29. The upper portion 30 of the valving element 29 constitutes a larger-diameter flange which prevents downward movement of the element 29 beyond the end position of FIG. 2. The upper side of the flange 30 has a centering pin 32 for the lowermost convolution or convolutions of the coil spring 31.

The main portion of the valving element 29 is formed with at least one passage including a centrally located axial bore 36 (see FIG. 4) whose lower end is in the lower end face of the valving element and one or more radially extending bores 34 which communicate with the bore 36 and terminate at the peripheral surface of the valving element 29 at a level below the flange 30. The lower end of the centrally located bore 36 is bounded by a conical surface which is complementary to the conical surface of the nipple 37 at the upper end of a properly positioned cartridge 38. The peripheral surface of the valving element 29 is further formed with a circumferentially complete groove for a sealing ring 39 which engages the surface surrounding the hole 41 so as to prevent uncontrolled leakage of ink from the chamber 28.

The orientation of the leg 2 of the frame 1 and hence of the entire apparatus can be altered by a handle 42. The leg 2 carries a centering pin 40 for the lower portion of a coil spring 43 which bears against the underside of a mobile platform 46. The latter is also provided with a handle 44 and can be turned about the upright 3 as well as pivoted up and down. Thus, a cartridge 38 which is placed onto the platform 46 can be moved to a position of and away from register with the housing 10. The underside of the platform 46 carries a fulcrum 47 for a two-armed lever 48 forming part of a means for deactivating the motor 18 when the refilling of a cartridge 38 is completed. The left-hand arm of the lever 48 carries a trip 50 for the switch 52 and the right-hand arm of this lever carries a vertically adjustable sensor 49 which extends through the opening **40*b* in the bottom wall 40*a* of a vessel 40 resting on the platform 46. The upright 3 further carries a locating arm 53 which facilitates the placing of an empty cartridge 38 into a position of exact register with the housing 10 so that the nipple 37 of such cartridge can penetrate into the lower end portion of the bore 36 and lift the valving element 29 from the lower end position of FIG. 2 to the upper end position of FIG. 4 as soon as the handle 44 is released, i.e., as soon as the coil spring 43 is free to pivot the platform 46 to the position of FIG. 1**.

The parts 21, 29 and 31 can be said to constitute a simple check valve which seals the outlet of the chamber 28 in automatic response to disengagement of the valving element 29 from the nipple 37 of a cartridge 38. At the same time, the check valve increases the effective volume of the chamber 28 in the aforedescribed manner and for the aforediscussed purpose.

The mode of operation of the improved apparatus is as follows:

The parts of the apparatus assume the positions of FIGS. 1 and 2 when the apparatus is idle. The motor 18 is at a standstill and the spring 31 maintains the flange 30 of the valving element 29 in contact with the upper side of the bottom wall of the screw cap 21. The outer end portions of the bores 34 in the valving element 29 are sealed from the chamber 28 as well as from the surrounding atmosphere.

If an empty cartridge 38 is to be filled or refilled, the operator pivots the platform 46 downwardly through the medium of the handle 44 so as to stress the coil spring 43 and to provide room for insertion of the cartridge into a position of register with the housing 10 whereby a portion of the cartridge extends into the complementary socket of the locating arm 53 on the upright 3. The sensor 49 on the right-hand arm of the deactivating lever 48 then extends through the hole **40*b* of the bottom wall 40*a* of the vessel 40 on the platform 46 but is out of contact with the piston 51 which is assumed to dwell in or close to the upper end position immediately or closely below the top wall 40*c* and nipple 37. When the handle 44 is released, the spring 43 is free to hold the cartridge 38 against movement away from the position of FIG. 4 and the valving element 29 is automatically held in the upper end position in which the radially extending bores 34 are free to communicate with the chamber 28. The volume of the chamber 28 is reduced in automatic response to upward movement of the valving element 29 from the end position of FIG. 2 to the end position of FIG. 4**.

The motor 18 is then started by a suitable switch, not shown (e.g., in automatic response to return movement of the platform 46 to the position of FIG. 4 provided that the locating arm 53 engages a properly inserted cartridge 38), so that the belt transmission 14, 16, 17 drives the shank 12 of the feed screw 9 and the helix of the feed screw advances a mass of ink from the tank 8 into the cylindrical space 19 of the sleeve 15 and into the range of the rotating distributor 23 whose segment-shaped opening 26 admits ink into successive apertures 27 of the stationary disc-shaped member 11.

The thus admitted ink flows from the chamber 28 into the nipple 37 of the cartridge 38 on the platform 46 by way of the passage or passages (bore 36 and bore or bores 34) in the lower portion of the valving element 29. Ink which penetrates into the vessel 40 pushes the piston 51 downwardly (note the arrow 60) whereby the piston 51 ultimately engages and depresses the sensor 49 so that the lever 48 is pivoted and its trip 50 arrests the motor 18 by way of the switch 52. The screw 9 then ceases to positively feed ink from the tank 8 into the chamber 28.

The operator thereupon engages the handle 44 and pivots the platform 46 against the opposition of the spring 43. This enables the filled cartridge 38 to descend whereby the coil spring 31 in the chamber 28 is free to expand and to return the valving element 29 to the lower end position of FIG. 2. During movement from the end position of FIG. 4 to the end position of FIG. 2, the valving element 29 increases the effective volume of the chamber 28 so that the pressure in the chamber drops and any ink which is still contained in the bores 34 as well as in the bore 36 is sucked back into the chamber 28 in automatic response to movement of the flange 30 into abutment with the bottom wall of the screw cap 21. Return flow of ink from the bores 34, 36 into the chamber 28 is completed not later than when the radially outermost portion(s) of the bore(s) 34 is (are) sealed by the surface surrounding the hole 41 in the screw cap 21.

The movement of the valving element 29 from the end position of FIG. 4 to the end position of FIG. 2 under the action of the coil spring 31 is rather abrupt so that the volume of the chamber 28 increases rapidly and the drop of pressure in the chamber is amply sufficient to ensure retraction of all traces of ink from the bores 34 and 36. Thus, the apparatus effectively prevents dripping of ink onto the filled or refilled cartridge 38, onto the platform 46 and/or onto the floor by the simple expedient of ensuring that the volume of the chamber 28 increases in automatic response to disengagement of the nipple 37 from the valving element 29, i.e., in automatic response to movement of the cartridge 38 to a position in which the coil spring 31 in the chamber 28 is free to expand.

The provision of the motor-driven feed screw 9 or of analogous means for positively advancing ink from the tank 8 into the housing 10 ensures that the chamber 28 is invariably filled with ink when the motor 18 is on. The rotary distributor 23 cooperates with the stationary disc-shaped member 11 of the housing 10 to ensure uniform distribution of ink in the chamber 28. An advantage of the deactivating means 48, 49, 50 is that the admission of ink into the cartridge 38 on the platform 46 is terminated automatically as soon as the cartridge receives a predetermined quantity of flowable medium.

It has been found that the improved apparatus allows for rapid, convenient and contamination-free filling or refilling of containers by an experienced attendant as well as by a semiskilled or even unskilled workman. This is accomplished by the simple expedient of increasing the volume of the chamber 28 in the housing 10 in response to movement of the valving element 29 from the end position of FIG. 4 to the end position of FIG. 2. Thus, ink which is confined in the housing 10 cannot drip, the cartridges 38 are not contaminated and the entire apparatus including the platform 46 remains clean for long periods of time. Moreover, ink cannot incrustate in the bores 34 and 36 of the valving element 29 so that the rate of discharge of ink is predictable, even if the apparatus is put to use after an extended period of idleness.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for admitting a flowable medium into containers for use in the printing unit of a machine for the making of rod-shaped articles of the tobacco processing industry, comprising a source of supply of flowable medium; a housing defining a variable-volume chamber for temporary reception of flowable medium; means for feeding flowable medium from said source into said chamber; and a valving element installed in said housing and defining at least one passage for evacuation of flowable medium from said chamber and for entry of evacuated medium into a container which is placed next to said housing, said valving element being movable between a first position in which said passage is free to convey flowable medium from said chamber and the valving element reduces the volume of said chamber, and a second position in which the volume of said chamber is increased as a result of movement of the valving element from the first to the second position and said passage is sealed from the container, said passage being in communication with said chamber during movement of said valving element to said second position so that the flowable medium in said passage is sucked back into said chamber in response to movement of said valving element from said first to said second position due to increasing volume of said chamber.

2. The apparatus of claim 1, wherein said feeding means includes means for forcibly advancing flowable medium from said source into said chamber.

3. The apparatus of claim 1, wherein said valving element comprises a plunger which is reciprocable between said first and second positions.

4. The apparatus of claim 3, wherein said plunger has a peripheral surface and an end face outside of said chamber, said housing having a hole for said plunger and said passage including at least one bore and having a first end in said end face and a second end in said peripheral surface, said second end of said passage being free to communicate with said chamber in the first position of said valving element and said second end of said passage being received in said hole and being sealed by said housing in the second position of said valving element.

5. The apparatus of claim 1, wherein said feeding means comprises a rotary feed screw.

6. The apparatus of claim 1, wherein said feeding means comprises a rotary medium advancing element having a distributor adjacent to said housing, said housing comprising an apertured member adjacent to said distributor and arranged to permit passage of streamlets of flowable medium which is supplied by said distributor.

7. The apparatus of claim 6, wherein said apertured member includes a disc having at least one annulus of apertures and said distributor includes a second disc which rotates with said advancing element and has at least one opening which sweeps along said apertures in response to rotation of said advancing element.

8. The apparatus of claim 7, wherein said second disc has a peripheral surface and said opening is provided in said peripheral surface.

9. The apparatus of claim 8, wherein said opening is segment shaped.

10. The apparatus of claim 1, further comprising means for yieldably biasing said valving element to said second position.

11. The apparatus of claim 10, wherein said biasing means comprises a spring which reacts against said housing and bears against said valving element.

12. The apparatus of claim 1 for admitting a flowable medium into containers of the type having a vessel and a piston movable in said vessel in a predetermined direction in response to admission of flowable medium into the container, and further comprising means for deactivating said feeding means in response to movement of the piston in such container to a predetermined position while the piston moves in said predetermined direction.

13. The apparatus of claim 12, wherein said feeding means comprises a prime mover and said deactivating means includes means for arresting said prime mover.

14. The apparatus of claim 1, wherein said housing includes a detachable portion and said valving element is installed in said detachable portion, said chamber being accessible upon detachment of said portion of said housing.

15. The apparatus of claim 1, wherein said feeding means comprises a rotary medium advancing element and said housing defines a cylinder for a portion of said rotary advancing element.

* * * * *